US008814062B2

(12) United States Patent
Lin

(10) Patent No.: US 8,814,062 B2
(45) Date of Patent: Aug. 26, 2014

(54) FLUID SPRAYING DEVICE

(75) Inventor: Wei Jen Lin, Taipei (TW)

(73) Assignee: Strong Fortress Tool Co., Ltd., Taipei (TW)

( * ) Notice: Subject to any disclaimer, the term of this patent is extended or adjusted under 35 U.S.C. 154(b) by 15 days.

(21) Appl. No.: 13/172,478

(22) Filed: Jun. 29, 2011

(65) Prior Publication Data

US 2012/0286071 A1 Nov. 15, 2012

(30) Foreign Application Priority Data

May 11, 2011 (TW) ..... 100116555 A

(51) Int. Cl.
*B05B 3/06* (2006.01)

(52) U.S. Cl.
USPC ..... 239/262; 239/251; 239/310; 239/318; 239/526

(58) Field of Classification Search
USPC ..... 239/243, 245, 246, 247, 263, 263.1, 239/263.3, 264, 265, 310, 314–316, 318, 239/251, 262, 526
See application file for complete search history.

(56) References Cited

U.S. PATENT DOCUMENTS

| | | | | |
|---|---|---|---|---|
| 2,931,580 A * | 4/1960 | Johnson | ..... | 239/346 |
| 3,285,521 A * | 11/1966 | Coakley | ..... | 239/318 |
| 3,446,438 A * | 5/1969 | Watson | ..... | 239/312 |
| 6,616,069 B1 * | 9/2003 | Jou | ..... | 239/525 |

* cited by examiner

*Primary Examiner* — Christopher Kim
(74) *Attorney, Agent, or Firm* — Cheng-Ju Chiang

(57) ABSTRACT

A fluid spraying device comprises a fluid tube rotatably disposed therein and a conveying tube disposed in the fluid tube. The fluid tube has a conveying section, a bent section, and a decreasing section connected therebetween. The decreasing section has a cross section area smaller than that of the bent section. One end of the conveying tube extends through the fluid tube to the decreasing section, so as to cause Venturi effect to cause a contained fluid being sprayed out from the conveying tube when a fluid flows through the fluid tube.

8 Claims, 5 Drawing Sheets

FLUID SPRAYING DEVICE

FIELD OF THE INVENTION

The present invention relates to a spraying gun, and more particularly to a fluid spraying device for spraying a mixed fluid.

BACKGROUND OF THE INVENTION

Many spraying guns have been used widely for cleaning dust and dirt from a surface of an object, for watering, for spraying paint, and the like. The spraying guns remove dust and dirt by spraying a high pressure fluid, and perform watering and spraying paint with the use of a high pressure fluid mixed with water or other spraying liquid.

As shown in FIG. 1, which is a perspective view illustrating a spraying gun in a conventional prior art. The spraying gun A in which a high pressure gas G is conveyed from a control handle A1 is disclosed in a conventional prior art. The high pressure gas G is conveyed, through a fluid tube A2, to a fluid spraying tube A3 provided at a front end of the spraying gun A, and is sprayed out of the fluid spraying tube A3. A conveying tube A4, which has a cross section area smaller than that of the fluid tube A3, is provided in the fluid tube A3. When the high pressure gas G is spraying out of the fluid tube A3, Venturi effect is induced at an outlet of the conveying tube A4, which effectively makes a spraying liquid L in a container A5 being sprayed out from the spraying gun A through the conveying tube A4.

In order to uniform the spraying distribution, the fluid tube A3 is made to have a bending shape and in rotation when driving. The conveying tube A4 disposed in the fluid tube A3 is made of a flexible material, so as to be deformed by bending with the rotation of the fluid tube A3. Thus, a mixed fluid of the high pressure gas G and spraying liquid L will be spraying uniformly in every direction with the rotation of the fluid tube A3. However, with the increasing time duration in use of the spraying gun A, the conveying tube A4 may wear down due to friction to the fluid tube A3 or may break due to material fatigue, that results in reducing of durability and parts replacement with increasing frequency.

SUMMARY OF THE INVENTION

In view of the above circumstances that the spraying gun in a conventional prior art has low the durability, that results in parts replacement with increasing frequency and inconvenient in use.

Therefore, it is an object of the present invention to provide a fluid spraying device whose friction between members is greatly reduced to zero so as to improve the durability and reduce frequency of parts replacement.

The present invention overcomes the drawbacks of the prior art, and provides a fluid spraying device comprising a fluid tube which is disposed in the fluid spraying device and is rotatable on an axis of the fluid spraying device, the fluid tube having a conveying section and a bent section, the conveying section being connected between a fluid input tube and the bent section, the bent section being rotatable together with the conveying section on the axis of the fluid spraying device, and the fluid input tube being connected to a fluid supply source, and a conveying tube being connected to a fluid container and being disposed in the fluid tube, wherein a decreasing section, having a cross section area smaller than that of the bent section, is provided between the conveying section and the bent section, and the conveying tube is provided extending through the conveying section to the decreasing section in such a manner that an output end of the conveying tube is positioned within the decreasing section.

In a preferred embodiment of the present invention, the cross section area of the decreasing section increases from the conveying section to the bent section.

In a preferred embodiment of the present invention, the conveying tube is made of a non-flexible material.

In a preferred embodiment of the present invention, the decreasing section of the fluid tube is an independent member and the conveying section of the fluid tube is an independent member.

In a preferred embodiment of the present invention, said decreasing section and said conveying section are further provided with an adjusting connection portion disposed therebetween.

In a preferred embodiment of the present invention, said adjusting connection portion is a screw connection portion.

In a preferred embodiment of the present invention, the fluid input tube is disposed in a control handle of the fluid spraying device.

In a preferred embodiment of the present invention, said control handle is further provided with a regulating means for regulating the flow rate of the fluid input from the fluid input tube.

Thereby, in the fluid spraying device of the present invention, the conveying tube and the fluid tube do not contact with each other so as to cause no friction therebetween. Further, the conveying tube is not deformed by bending with the rotation of the fluid tube. Thus, the conveying tube does not easily wear down and does not easily break from material fatigue, so as to improve the durability and reduce frequency of parts replacement.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
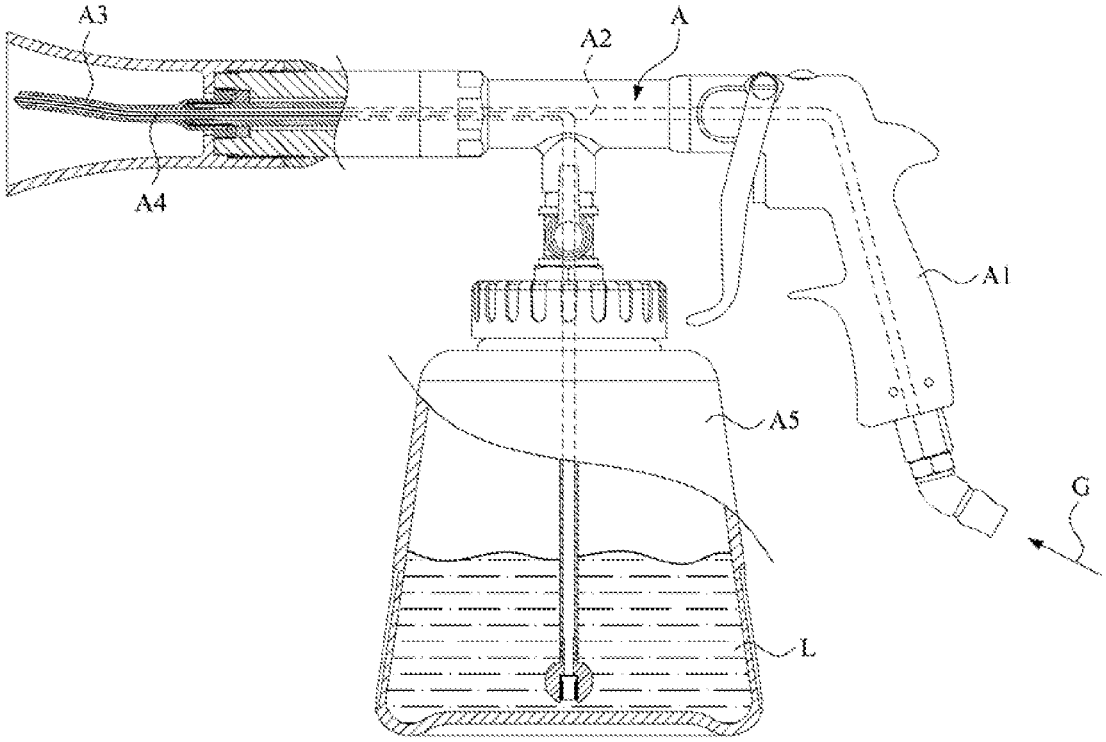
FIG.1(Prior Art)
FIG. 1 is a perspective view illustrating a spraying gun in a conventional prior art.
Figure 2:
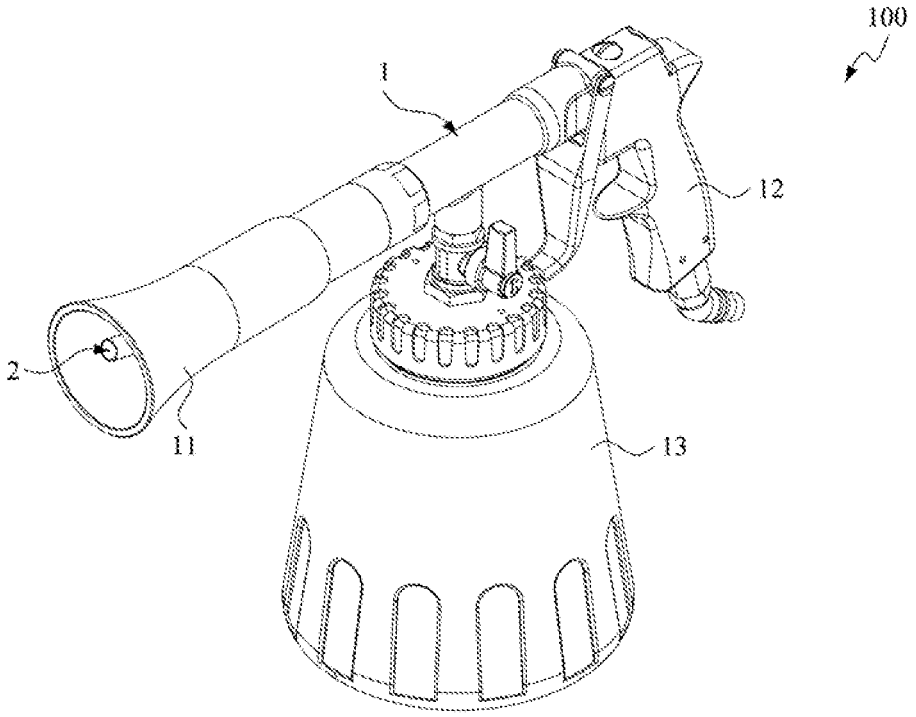
FIG. 2 is a perspective view illustrating an embodiment according to the present invention.
Figure 3:
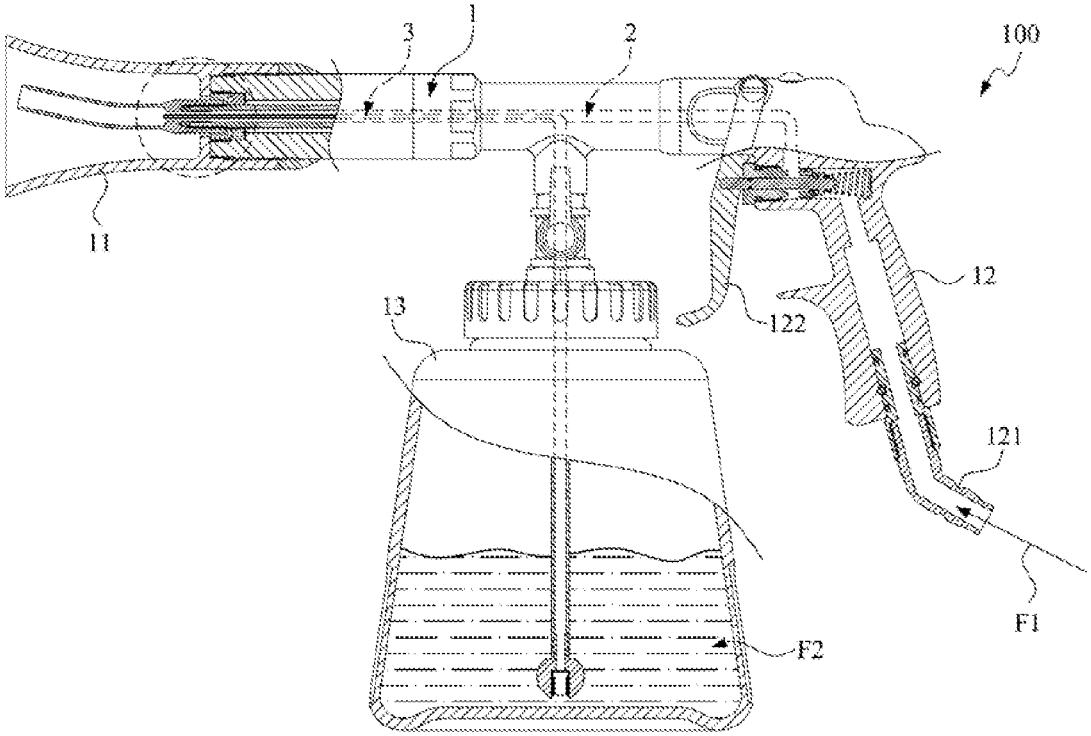
FIG. 3 is a cross-section view of FIG. 2.
Figure 4:
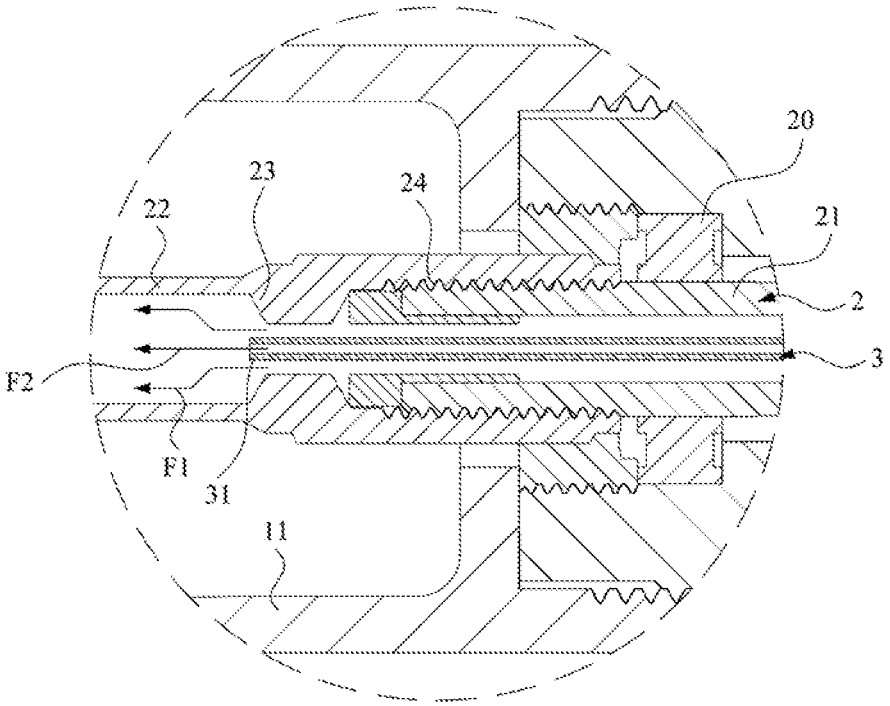
FIG. 4 is a partial enlarged view of FIG. 3.
Figure 5:
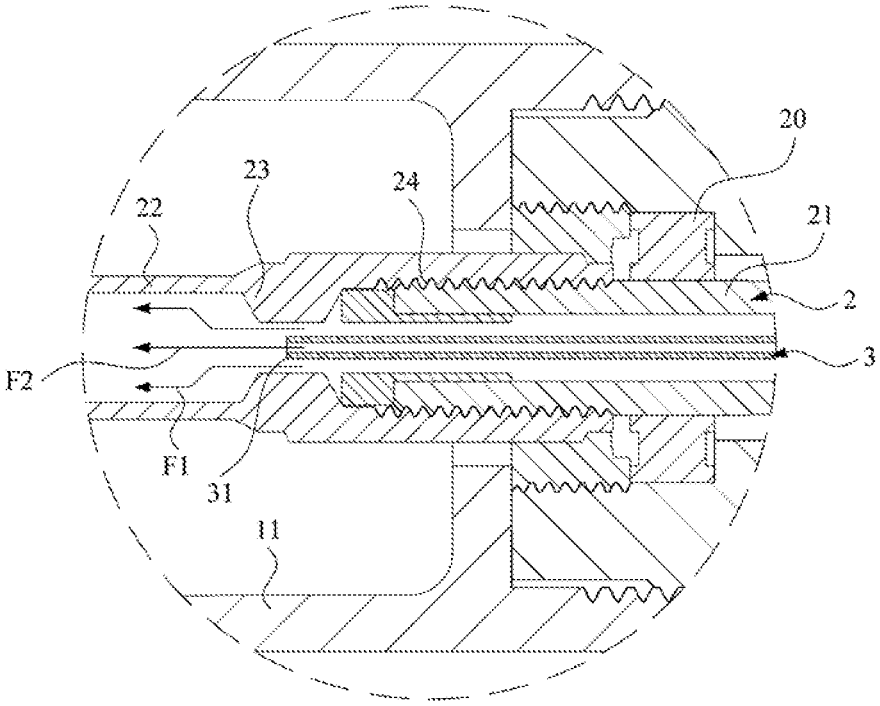
FIG. 5 is a cross-section view illustrating another embodiment according to the present invention.

Please refer to FIG. 2-5. FIG. 2 is a perspective view illustrating an embodiment according to the present invention, FIG. 3 is a cross-section view of FIG. 2, FIG. 4 is a partial enlarged view of FIG. 3, and FIG. 5 is a cross-section view illustrating another embodiment according to the present invention.

A fluid spraying device 100 according to an embodiment of the present invention include a body 1. The body 1 is provided at one end thereof with a spraying head 11 and the other end thereof with a control handle 12, and is assembled with a fluid container 13.

A fluid tube 2, which is provided in the body 1 of the fluid spraying device 100, is assembled to the body 1 with a bearing 20, so as to be rotatable on an axis of the fluid spraying device 100. There are many structures that enable the fluid tube 2 to be rotatable in the body 1, for example, a structure in which the fluid tube 2 combines with a motor, a fan, or the like may be given. However, the present invention is not limited to this structure, and any structure that enables the fluid tube 2 to be rotatable can be used.

The fluid tube 2 has a conveying section 21, a bent section 22, and a decreasing section 23.

The conveying section 21 is connected with a fluid input tube 121 provided in the control handle 12. The fluid input tube 121 is used for connecting to a fluid supply source (not illustrated), so as to enable a fluid F1 from the fluid supply source being conveyed to the conveying section 21 through the fluid input tube 121. In addition, a regulating means 122, which functions as a valve, is further provided in the handle 12 to regulate the flow rate of the fluid F1 input from the fluid input tube 121 or to prevent the fluid F1 from flowing into the fluid tube 2 by closing the valve.

The bent section 22, which is disposed in the spraying head 11 of the body 1 and has a bent configuration, is connected with the conveying section 21. The bent section 22 is rotatable together with the conveying section 21 on the axis of the fluid spraying device 100. With such structure, the fluid F1 conveyed to the fluid tube 2 may be sprayed in every direction with the rotation of the bent section 22 when the fluid tube 2 is rotated.

The decreasing section 23, which has a cross section area smaller than that of the bent section 22, is connected between the conveying section 21 and the bent section 22. In this embodiment, the cross section area of the decreasing section 23 increases from the conveying section 21 to the bent section 22. However, the present invention is not limited to this, and the decreasing section 23 which has the cross section area smaller than that of the conveying section 21 can be provided.

A conveying tube 3 is disposed in the fluid tube 2. The conveying tube 3 is provided with one end connected with the fluid container 13 so as to convey a contained fluid F2 which is contained in the fluid container 13. The conveying tube 3 is provided the other end as an output end 31 extending, through the conveying section 21 of the fluid tube 2, to the decreasing section 23 (as illustrated in FIG. 4 and FIG. 5).

When the fluid F1 conveyed in the fluid tube 2 flows through the decreasing section 23 of the fluid tube 2, Venturi effect is induced at an output end 31 of the conveying tube 3. This effect makes the contained fluid F2 contained in the fluid container 13 being sucked into the conveying tube 3 and then outputting from the output end 31 of the conveying tube 3. After that, the contained fluid F2 output from the output end 31 of the conveying tube 3 will be mixed with the fluid F1 and sprayed outside through the bent section 22.

A location at which the output end 31 of the conveying tube 3 is provided affects the inducing of Venturi effect, that is, flow rate of the contained fluid F2 output from the output end 31 of the conveying tube 3 is changed by the location of the output end 31. In this embodiment, the decreasing section 23 of the fluid tube 2 is an independent member and the conveying section 21 of the fluid tube 2 is an independent member, and the decreasing section 23 is movably connected with the conveying section 21 in order to adjust the flow rate of the contained fluid F2. Specifically, an adjusting connection portion 24, which is a screw connection portion in this embodiment, is provided between the conveying section 21 and the decreasing section 23. With such structure, location of the decreasing section 23 can be adjusted, so that the relative location between the output end 31 of the conveying tube 3 and the decreasing section 23 of the fluid tube 2 is changed.

With the structure disclosed in the present invention, the conveying tube 3 and the fluid tube 2 do not contact with each other so as to cause no friction therebetween. Further, because the conveying tube 3 will not deformed by bending with the rotation of the fluid tube 2, the conveying tube 3 can be made of a non-flexible material to enhance structural strength thereof.

As can be appreciated from the above embodiments, the fluid spraying device of the present invention has industry worth which meets the requirement for a patent. The above description should be considered as only the discussion of the preferred embodiments of the present invention. However, a person having ordinary skill in the art may make various modifications to the present invention. Those modifications still fall within the spirit and scope defined by the appended claims.

What is claimed is:

1. A fluid spraying device comprising:

a fluid tube for a first fluid flowing therein disposed in the fluid spraying device and rotatable along an axis of the fluid spraying device, the fluid tube comprising a conveying section and a bent section, the conveying section being connected between a fluid input tube and the bent section, the bent section being rotatable together with the conveying section along the axis of the fluid spraying device, and the fluid input tube being connected to a fluid supply source for entry of the first fluid, and a conveying tube being connected to a fluid container receiving a second fluid and being disposed in the fluid tube;

wherein a decreasing section of the fluid tube, having a fluid flowing cross section area within the decreasing section smaller than a fluid flowing cross section area of each of the conveying section and the bent section, is provided and defined between the conveying section and the bent section, the first fluid flowing to pass through the fluid flowing cross section area of the conveying section completely flows to pass through the fluid flowing cross section area of the decreasing section and the fluid flowing cross section area of the bent section subsequently in sequence, and the conveying tube is provided extending through the conveying section to the decreasing section in such a manner that an output end of the conveying tube is positioned within the decreasing section, so as to convey the second fluid from the fluid container through the conveying tube to the bent section while the first fluid flows from the fluid supply source through the fluid tube and the decreasing section to the bent section.

2. The fluid spraying device as claimed in claim 1, wherein the fluid flowing cross section area of the decreasing section increases from a middle part of the decreasing section to the conveying section and the bent section, respectively.

3. The fluid spraying device as claimed in claim 1, wherein the conveying tube is made of a non-flexible material.

4. The fluid spraying device as claimed in claim 1, wherein the decreasing section of the fluid tube is an independent member from the conveying section of the fluid tube.

5. The fluid spraying device as claimed in claim 4, wherein the decreasing section and the conveying section are further provided with an adjusting connection portion disposed therebetween to adjust a location of the decreasing section relative to the conveying section.

6. The fluid spraying device as claimed in claim 5, wherein the adjusting connection portion is a screw connection portion.

7. The fluid spraying device as claimed in claim 1, wherein the fluid input tube is disposed in a control handle of the fluid spraying device.

8. The fluid spraying device as claimed in claim 7, wherein the control handle is further provided with a regulating means for regulating the flow rate of the first fluid input from the fluid input tube.

* * * * *